United States Patent [19]

Corfield

[11] 4,072,841

[45] Feb. 7, 1978

[54] ELECTRICAL SWITCHES

[75] Inventor: John Courtney Corfield, Waltham St. Lawrence, England

[73] Assignee: Unimax Switch Limited, Maidenhead, England

[21] Appl. No.: 727,851

[22] Filed: Sept. 29, 1976

[30] Foreign Application Priority Data

Oct. 1, 1975 United Kingdom ..... 40110/75

[51] Int. Cl.[2] ..... H01H 3/04

[52] U.S. Cl. ..... 200/332; 200/67 D; 200/335

[58] Field of Search ..... 200/332, 335, 67 R, 200/67 D, 67 B

[56] References Cited

U.S. PATENT DOCUMENTS

| | | | |
|---|---|---|---|
| 3,480,752 | 11/1969 | Cherry et al. | 200/335 |
| 3,755,642 | 8/1973 | Warner | 200/332 |
| 3,965,316 | 6/1976 | Olson | 200/67 D |

*Primary Examiner*—David Smith, Jr.

*Attorney, Agent, or Firm*—Bernard Malina

[57] ABSTRACT

A micro-switch having an actuating mechanism comprising a slide member which is movable longitudinally of itself in the switch casing and engages the electrical switching element, and a pivoted actuator which extends externally of the switch casing and comprises a length of wire which is pivoted in a hole in the switch casing and which has a bent end portion within the casing which is connected to the slide member so that pivoting of the actuator in one particular sense causes the slide member to move longitudinally to operate the switching element. Preferably, said end portion of the wire is connected to the inner end of the slide member by engaging an aperture or recess in the latter. The recess is conveniently a transverse channel formed in the side face of the slide member which is exposed on removal of a switch cover. That portion of the wire projecting from the other side of the casing can be bent through 90° so as to form an operating arm which can readily be pointed in any direction and may be of any length.

12 Claims, 4 Drawing Figures

ELECTRICAL SWITCHES

Figure 1:
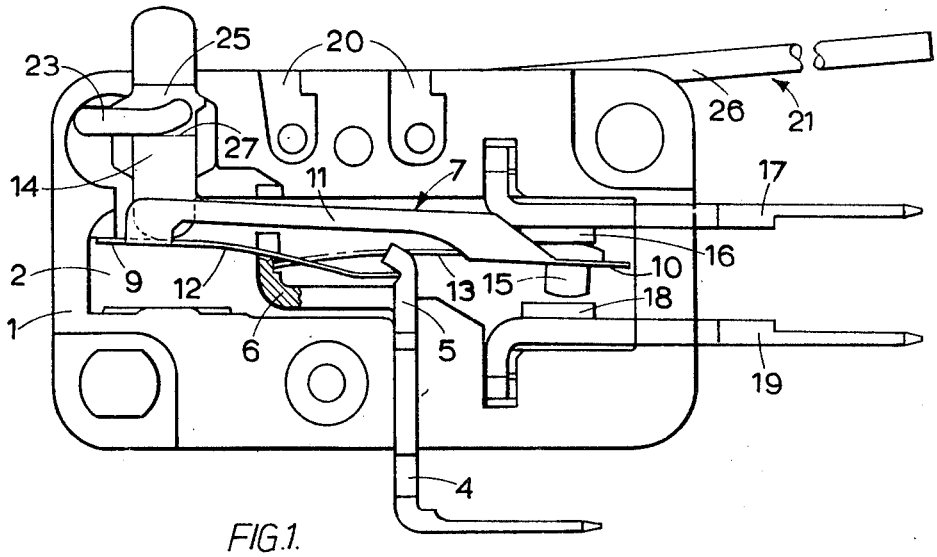

This invention relates to snap-action switches, commonly known as micro-switches, and in particular, to snap-action switches in which an actuating mechanism co-operates with an electrical switching element within the switch casing and is movable between non-operated and operated positions in which the switching element assumes respective first and second switching positions, the switching element acting at all times to urge the actuating mechanism to the non-operated position.

Micro-switches can be broadly divided into two types according to the actuating mechanism which they employ. One type may be called push-button micro-switches and comprise a slide member which is movable longitudinally of itself in the switch casing and which projects externally of the casing at one end for operation thereby, and directly engages the electrical switching element at its other end within the switch casing. Micro-switches of this type have been provided with a lever which is pivoted in an outer wall of the switch casing and which engages the projecting end of the slide member so that the latter is pressed inwardly when the lever is operated.

The second type of micro-switch is called a rotary action micro-switch or a coin micro-switch because it is widely used for coin detection. This type of micro-switch comprises a pivot pin which is mounted in bearings in the switch casing and which carries cam means within the switch casing and a wire actuator which projects from one end of the pivot pin externally of the casing. The cam engages the electrical switching element within the switch casing and moves this element when rotated by operation of the actuator.

Coin micro-switches are generally considered to be more sensitive than push-button micro-switches, but they are more expensive to manufacture because of the greater complexity of the cam actuating mechanism as compared with the push-button actuating mechanism.

An object of the present invention is to provide a micro-switch with comparable sensitivity to that of a coin micro-switch but which is less costly to manufacture.

This object is achieved according to the present invention by providing a micro-switch having an actuating mechanism comprising a slide member which is movable longitudinally of itself in the switch casing and engages the electrical switching element, and a pivoted actuator which extends externally of the switch casing and comprises a length of wire which is pivoted in a hole in the switch casing and which has a bent end portion within the casing which is connected to the slide member so that pivoting of the actuator in one particular sense causes the slide member to move longitudinally to operate the switching element. The invention therefore retains the basic simplicity of the push-button micro-switch by using a slide member to operate the electrical switching element, but provides increased sensitivity by using a simple pivoted actuator to operate the slide member. It will be appreciated that existing push-button micro-switches can easily be adapted so as to incorporate the present invention.

Preferably, said end portion of the wire is connected to the inner end of the slide member by engaging an aperture or recess in the latter. In one embodiment in which a cover plate closes one side of the switch casing, the recess is conveniently a transverse channel formed in the side face of the slide member which is exposed on removal of the cover plate. Said end portion of the wire is bent through 90° so as to lie in a plane perpendicular to the pivot portion of the wire, and the latter is inserted through the hole in the casing perpendicular to the cover plate so that said end portion engages lengthwise in the channel in the slide member. That portion of the wire projecting from the other side of the casing can then be bent through 90° so as to form an operating arm which can readily be pointed in any direction and may be of any length to suit different applications and to give the required sensitivity.

The point of engagement of said end portion of the wire with the inner end of the slide member is preferably kept as close as possible to the pivot axis defined by said pivot hole so that increased leverage, and thus greater sensitivity of operation, is obtained. In order to achieve this end, said point of engagement can be defined by appropriate shaping of said end portion of the wire or of the slide member or both. For example, in those examples in which said end portion engages a recess in the slide member, said end portion may be curved in its plane of movement so that it engages an edge portion of the recess nearest said pivot axis, or the slide member may have a shaped recess so that it is formed with a lip which is engaged by said end portion. Preferably, said lip forms a projection which extends from the slide member towards said pivot axis. This last mentioned arrangement can also be advantageous in allowing said hole for the wire to be located further from the main body of the slide member without suffering any loss of sensitivity.

Figure 2:
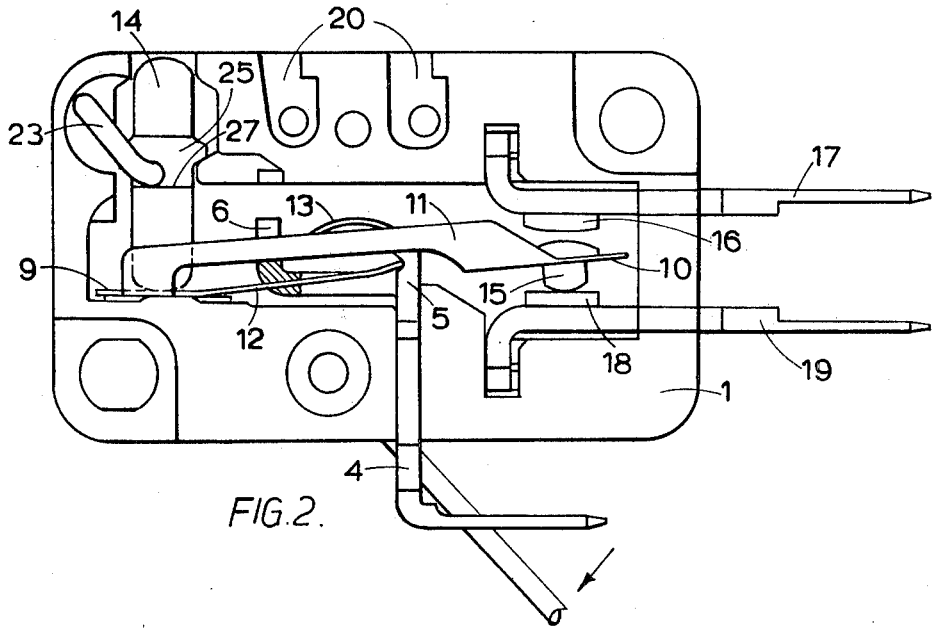
Figure 3:
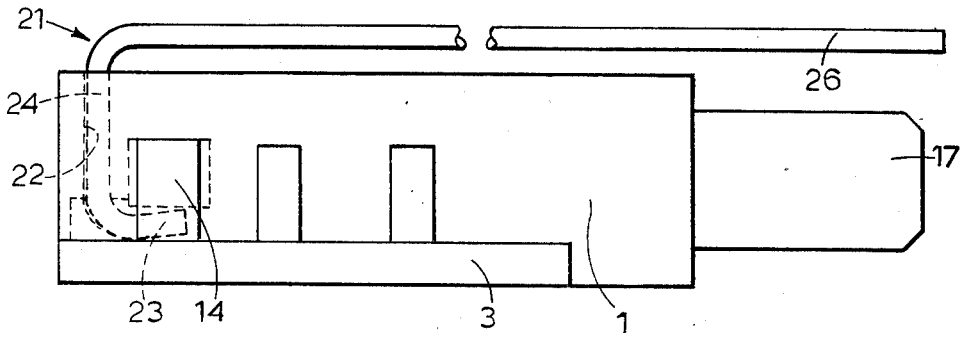
Figure 4:
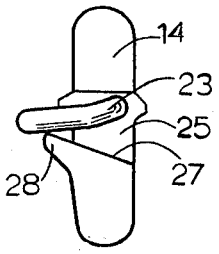

The invention will now be described by way of example with reference to the accompanying drawings in which:

FIG. 1 is a slide elevational view of a micro-switch according to the invention with the cover plate removed, FIG. 2 is a similar view to that of FIG. 1, except that the switch is shown in its operated state, FIG. 3 is a plan view of the switch of FIGS. 1 and 2, and FIG. 4 is a side elevational view of an alternative form of slide member or push button which can be used in the switch of FIGS. 1 to 3.

The micro-switch illustrated in FIGS. 1 to 3 is basically a known switch of the push-button type comprising a casing 1 of moulded plastics having an internal cavity 2 which is closed at one side by a plastics cover plate 3. An input terminal 4 is mounted in the casing 1 and has a pair of lugs 5 and a single offset lug 6 within the cavity 2 which between them support an electrically conducting switching element 7.

The switching element 7 is formed from a single piece of resilient sheet metal and comprises an operating end portion 9 and a contact carrying end portion 10 which are connected by upturned side portions 11, and a pair of limbs 12 which extend inwards from the operating end portion 9 so as to engage the pair of lugs 5, and a single central limb 13 which extends inwards from the contact carrying end portion 11 between the limbs 12 so as to engage the offset lug 6. The limbs 12 and 13 are flexed in such a manner that they act jointly to urge the operating end portion 9 upwards into engagement with the lower end of a plastics push-button 14 which is a longitudinal slide fit in the casing 1 and projects externally of the casing. When the push-button 14 is in its non-operated, raised position as shown in FIG. 1, the flexed limbs 12 and 13 urge a contact 15 on the contact carrying end portion 10 upwards into engagement with a contact 16 on an outlet terminal 17, and when the push-button 14 is depressed beyond an over-centre position as shown in FIG. 2, the flexed limbs 12 and 13 urge the contact 15 downwards into engagement with a contact 18 on an outlet terminal 17. The push-button 14 is thus urged into its non-operated position by the switching element 7 and in turn controls a snap switching action of the latter between the input terminal 4 and closed and normally open output terminals 17 and 19, respectively.

As so far described, the micro-switch is of known construction. Conventionally, the push-button 14 is operated either directly or through a pivoted lever, the fulcrum of which is a snap fit in a recess 20 in the top of the switch casing 1 adjacent the button. However, the illustrated switch has been adapted according to the invention by providing a pivoted actuator to operate the push-button 14, the actuator 21 comprising a length of wire which is pivoted in a plain hole 22 in the casing 1 and has a bent end portion 23 within the casing by which it is connected to the button.

The pivot hole 22 extends perpendicular to the line of movement of the button 14, and the end portions of the wire 23 is bent through 90° relative to the pivot portion 24 in the hole 22 so as to engage a recess 25 in the button. In particular, the recess 25 takes the form of a transverse channel in that face of the push-button 14 which is exposed on removal of the cover plate 3, and the pivot hole 22 and pivot portion 24 of the wire therein, extend perpendicular to the side faces of the casing 1 so that the end portion 23 simply extends sideways along the length of the channel 25.

The end of the wire which projects externally of the casing 1 from the pivot hole 22 is made long enough so that it can be bent through 90° to form the operating arm 26 of the actuator 21.

The pivot hole 22 is located close to the push-button 14 so as to reduce the distance between the pivot axis and the point of contact of the end portion 23 with the lower side wall 27 of channel 25, thereby increasing the overall leverage of the actuator 21. The distance between the pivot axis and the point of contact is further reduced by curving the end portion 23 in its plane of movement so that the point of contact between it and the side wall 27 of the channel 25 remains close to that end of the side wall nearest the pivot axis throughout the operating movement of the actuator. As shown in FIG. 1, the necessary curvature is such that the end portion 23 curves upwards away from the side wall 27 beyond its initial point of contact when the actuator and push-button are in their non-operated positions.

The transverse channel 25 in the push-button 14 of the micro-switch illustrated in FIGS. 1 to 3 has a lower side wall 27 which is perpendicular to the line of movement of the push-button. However, in an alternative embodiment of the invention this side wall may be inclined relative to the line of movement of the push-button or otherwise shaped in a curved manner so as to form a lip 28 at that end of the side wall nearest the pivot axis for engagement by the end portion 23 of the wire. For example, FIG. 4 illustrates an alternative push-button 14 having a transverse groove 25 with an inclined lower side wall 27 which slopes downwards away from a lip 28 at that end nearest the pivot axis. As illustrated, this button is used with the actuator 21 of FIGS. 1 to 3 in which the end portion 23 is curved. However, it is possible to use this button with an actuator having a straight end portion 23.

In another alternative embodiment of the invention, the bent end portion of the actuator may engage a projection which extends from the push-button towards the pivot axis, thereby reducing the distance between the pivot axis and the point of contact between the end portion and the button, and thus increasing the overall leverage of the actuator. This feature is incorporated in the push-button 14 of FIG. 4 in which the projection takes the form of the lip 28 which extends away from the button towards the pivot axis.

I claim:

1. A snap-action switch comprising a casing, a slide member which is movable longitudinally of itself in the switch casing between non-operated and operated positions, an electrical switching element within the casing which is engaged by the slide member and is moved from a first to a second switching position respectively as the slide member is moved from the non-operated to the operated position, and a pivoted actuator which extends externally of the casing and controls movement of the slide member from the non-operated position to the operated position, the actuator comprising a length of wire which is pivoted in a hole in the switch casing and which has a bent end portion within the casing which is connected to the slide member so that pivoting of the actuator in one particular sense causes the slide member to move from the non-operated to the operated position.

2. A switch as claimed in claim 1 in which the end portion of the wire is connected to the slide member by engaging an aperture or recess in the latter.

3. A switch as claimed in claim 2 in which the end portion of the wire is bent through 90° relative to the pivot portion of the wire within the hole in the switch casing so as to lie in a plane perpendicular to the hole.

4. A switch as claimed in claim 3 in which the end portion of the wire projects from the pivot portion of the wire lengthwise along a channel formed in a side face of the slide member transverse to the longitudinal axis of the latter.

5. A switch as claimed in claim 4 in which the casing is closed on one side by a cover plate which when removed exposes the side face of the slide member in which said channel is formed, the hole and pivot portion of the wire extending through the casing perpendicular to the cover plate.

6. A switch as claimed in claim 3 in which the end portion of the wire is curved in its plane of movement so that it engages an edge portion of the recess nearest the hole in the casing as the actuator moves from the non-operated position to the operated position.

7. A switch as claimed in claim 3 in which the aperture or recess is shaped so as to form a lip on that portion nearest the hole in the casing, the lip being engaged by the end portion of the wire as the actuator moves from the non-operated position to the operated position.

8. A switch as claimed in claim 1 in which the end portion of the wire engages a projection which is formed on the slide member so as to project towards the hole in the casing.

9. A switch as claimed in claim 1 in which the wire projects externally from the hole in the casing and is bent to form an operating arm.

10. A switch as claimed in claim 9 in which the operating arm extends perpendicular to the hole in the casing.

11. A switch as claimed in claim 1 in which the slide member projects externally of the casing at one end.

12. A switch as claimed in claim 1 in which the electrical switching element acts at all times to urge the slide member to the non-operated position.

* * * * *